US011293237B2

(12) United States Patent
Jostes et al.

(10) Patent No.: US 11,293,237 B2
(45) Date of Patent: Apr. 5, 2022

(54) GROUND DRILLING DEVICE AND USE OF A GROUND DRILLING DEVICE

(71) Applicant: TRACTO-TECHNIK GmbH & Co. KG, Lennestadt (DE)

(72) Inventors: Lucas Jostes, Finnentrop (DE); Stefan Hermes, Lennestadt (DE); Dieter Wurm, Kirchhundem (DE); Sebastian Fischer, Lennestadt (DE); Lars Rosenthal, Lennestadt (DE); Markus Hamers, Lennestadt (DE); Thomas Himmelreich, Schmallenberg (DE); Christian Loher, Eslohe (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 16/782,636

(22) Filed: Feb. 5, 2020

(65) Prior Publication Data

US 2020/0256138 A1 Aug. 13, 2020

(30) Foreign Application Priority Data

Feb. 13, 2019 (DE) ..... 10 2019 001 046.9

(51) Int. Cl.

| | |
|---|---|
| ***E21B 19/00*** | (2006.01) |
| ***E21B 19/20*** | (2006.01) |
| ***E21B 19/15*** | (2006.01) |
| *E21B 7/02* | (2006.01) |
| *E21B 7/04* | (2006.01) |
| *E21B 19/18* | (2006.01) |
| *E21B 19/24* | (2006.01) |

(52) U.S. Cl.

CPC ..... *E21B 19/20* (2013.01); *E21B 19/15* (2013.01); *E21B 7/025* (2013.01); *E21B 7/046* (2013.01); *E21B 19/18* (2013.01); *E21B 19/24* (2013.01)

(58) Field of Classification Search

CPC ..... E21B 19/20; E21B 19/15; E21B 19/18; E21B 19/24; E21B 7/025; E21B 7/076

See application file for complete search history.

(56) References Cited

U.S. PATENT DOCUMENTS

| | | | | |
|---|---|---|---|---|
| 4,202,653 | A | 5/1980 | Moller | |
| 8,562,269 | B2 | 10/2013 | Hermes et al. | |
| 2010/0104401 | A1* | 4/2010 | Hopkins | E21B 19/155 414/22.54 |
| 2011/0200413 | A1* | 8/2011 | Hermes | E21B 19/20 414/22.62 |
| 2016/0281445 | A1 | 9/2016 | Wang et al. | |

FOREIGN PATENT DOCUMENTS

| | | | |
|---|---|---|---|
| CN | 104165031 | B | 11/2014 |
| CN | 206737862 | U | 12/2017 |
| DE | 10 2009 035 277 | A1 | 2/2011 |
| DE | 202011110844 | U1 | 10/2016 |

* cited by examiner

*Primary Examiner* — Taras P Bemko

(74) *Attorney, Agent, or Firm* — Howard IP Law Group, P.C.

(57) ABSTRACT

A ground drilling device has a drilling carriage which defines a drill string axis, a drill rod magazine for a plurality of rod sections, and a transfer device for the transfer of a rod section between the drill rod magazine and a position of the rod section in the direction of the drill string axis. The ground drilling device also has a guide on a top of the drill rod magazine that is configured to guide movement of the transfer device.

16 Claims, 2 Drawing Sheets

GROUND DRILLING DEVICE AND USE OF A GROUND DRILLING DEVICE

FIELD OF INVENTION

The invention relates to a ground drilling device and a use of a ground drilling device.

BACKGROUND

From DE 10 2009 035 277 A1 there is known a drilling device, comprising a drill rod magazine with a plurality of rod sections stored therein, a drilling carriage, as well as a transfer device, with which the rod sections can be removed from the drill rod magazine and be positioned in the drilling carriage. The drill rod magazine is positioned next to a base support of the drilling carriage. The drill rod magazine has the shape of a cuboid and is composed of a plurality of interconnected frame profiles. At the top end of the drill rod magazine the magazine has an open configuration, so that the transfer device can reach into the drill rod magazine and remove a rod section. The transfer device is connected by a carrier frame to both an outer wall of the drill rod magazine and the base support of the drilling carriage. Horizontally oriented racks are present on the carrier frame, meshing together with driving gears of a drive. A gripping unit of the transfer device can be moved along the horizontal racks in the horizontal direction.

It has been found that, while the known drilling devices achieve good results, the construction is complex in regard to the drill rod magazine and the transfer device.

SUMMARY

Now, the problem which the invention proposes to solve is to provide a drill rod magazine on a ground drilling device and a transfer device for the transfer of a rod section in simple manner, making possible a simple construction and/or a simple design.

The key idea of the invention is that a guide for a movement of the transfer device is present on the drill rod magazine itself. In this way, the use of material and/or the structural layout can be reduced. The inventors have broken with the notion that a support structure for the transfer device needs to be provided independently of the drill rod magazine. Formerly, the design of the transfer device was hampered by the notion that a structure had to be created above the drill rod magazine in order to grasp the drill rod magazine or the rod sections located in the drill rod magazine. The considerations were based on a maximum stabilization of the suspension or arrangement of the transfer device, and furthermore it was regarded as being only possible to achieve a maximum stability of the drill rod magazine by constructing the drill rod magazine and the transfer device independently of each other, due to the weight of the rod sections.

The invention creates a ground drilling device with a drilling carriage, which defines a drill string axis. The ground drilling device moreover comprises a drill rod magazine for a plurality of rod sections and a transfer device for the transfer of a rod section between the drill rod magazine and a position of the rod section in the direction of the drill string axis. A guide for a movement of the transfer device is present on the drill rod magazine.

The term "ground drilling device" encompasses in the sense of the specification any device which moves in particular a drill string having rod sections in an existing or yet to be created conduit in the soil, in order to create or widen a borehole, particularly a horizontal borehole (HD), or to draw pipelines or other long bodies into the soil. The ground drilling device may be in particular a HD device. A ground drilling device may be a device driving forward a drill string, which can work in particular by soil displacement, and place the drill string into the soil by translatory and/or rotatory movement in the lengthwise axial direction of the drill string. A borehole may be placed in the soil by applying pulling or pushing to the drill string.

The term "soil" encompasses in the sense of the present specification in particular any kind of material, particularly dirt, sand and/or rock, in which existing or yet to be created conduits or boreholes can be made, preferably being horizontal at least for a portion.

The term "drilling carriage" encompasses a frame, particularly a movable frame, on which a sliding carriage can be provided for moving the drill string, which can move back and forth in the direction of the drill string axis in order to move the drill string in the soil by pushing or pulling. The drilling carriage generally comprises at least the sliding carriage and/or a linear drive for advancement of the drill string. The linear drive may additionally or alternatively comprise a rotation drive for the rotational driving of the drill string. The drilling carriage can moreover comprise one or more clamping devices, by which the drill string or a rod section being attached can be secured. It may be provided that a clamping device is provided on the drilling carriage, by means of which the free end of the drill string can be secured, in order to enable a new rod section to be connected to the already introduced drill string.

The term "drill string axis" means in particular the axis formed by the longitudinal axes of the individual rod sections of the drill string, considering the longitudinal axes of the rod sections which are situated in the near region of the ground drilling device in the drill string.

The term "drill string" in the sense of the invention encompasses any means which can be introduced into the soil in order to make a borehole in the soil. In particular, the drill string may comprise a rod, a chain, and/or a cable. The term "drill string" encompasses in the sense of the specification not only rigid, individual drill strings having rod sections connected directly or indirectly to each other, but also in particular any force transmitting elements which can be used in a ground drilling device. Moreover, the drill string comprises at one end, particularly the front end, a drilling head and optionally a drilling head tip or a region adjacent to the drilling head, which may have in particular the same orientation as the drilling head. In a particularly preferred embodiment, it is proposed to design a front end segment of a drill string as a drilling head or drilling tool.

The term "transfer device" in the sense of the specification encompasses a device for grasping a rod section, particularly by means of one or more gripping devices. The transfer device has the ability to move the at least one gripping device, by means of which a rod section, particularly one in the drill rod magazine, can be picked up or grasped and moved into a position in the direction of the drill string axis. It may also be possible for the transfer device to move a rod section from a position in the direction of the drill string axis into the drill rod magazine, for example when the drill string is being pulled out from the soil. The at least one gripping device can be moved vertically and horizontally, both transversely to and in the longitudinal direction, parallel to the drill string axis. The transfer device may be designed in particular like the transfer device known from DE 10 2009 035 277 A1.

In the sense of the specification, the term "guide" encompasses one or more structural element along which another structural element can be moved. A guide dictates the direction of movement and may serve in particular as a support. The guide may comprise one or more rails, which is or are oriented in particular transversely to the drill string axis. The guide may be designed as one or more profiled rail. The guide(s) may have the transfer device reaching around them. The guide(s) may be designed as an open profile without the transfer device reaching around them. The guide may be designed as a linear guide. The transfer device can be moved in the guide by means of sliding pieces, rollers, or the like.

A "drill rod magazine" in the sense of the invention encompasses in particular a magazine having two end elements or head pieces, on which separating elements are provided. The separating elements may be oriented toward each other in particular, so as to dictate a partitioning or compartments or rows of the rod sections in the drill rod magazine.

In one preferred embodiment, the guide is designed for a movement of the transfer device transversely to the drill string axis. In this way, the drill rod magazine can be arranged next to the drilling carriage. A simple transfer or handover from the drill rod magazine to the drill string axis is possible. A rotation and/or a moving of the rod section along the drill string axis can be reduced.

In one preferred embodiment, the drill rod magazine comprises two head pieces extending transversely to the longitudinal direction of the carriage, on each of which at least one guide for the transfer device is arranged. The guide can be connected directly to a head piece. The guide may be connected directly to the head piece at the top of the head piece. In this way, a simple design of the drill rod magazine as a guide can be used. The orientation of the drill rod magazine with the head piece can be used to simplify the orienting of the transfer device or the gripping device of the transfer device. The transfer device can be used for the stabilization in the longitudinal direction of the drill rod magazine. A mutual stabilization is possible. It may also be provided that the head pieces are screwed and/or welded to the drilling carriage without providing a direct stabilization by means of the transfer device, for example when the guide(s) are designed as an open profile.

In one preferred embodiment, the head pieces are designed so that they can be connected separately to the carriage. A transport of the drill rod magazine is simplified, comprising basically the two head pieces with the separating elements arranged thereon. The simplification involves both the spatial extension of the drill rod magazine and the material used for the drill rod magazine. No frame need be used, which is more difficult to handle than the two individual head pieces.

In one preferred embodiment, the drill rod magazine is designed with no connection struts between the two head pieces, i.e., no connection struts need to be provided to join the head pieces together. Material can be economized in this way. The two head pieces can be handled independently of each other. A stabilization can be accomplished in particular by the transfer device, which is connected to the two head pieces, each of the head pieces having a guide or being able to be connected to a guide.

In one preferred embodiment, the transfer device comprises two gripping devices for grasping a rod section. In this way, a secure handling by means of the transfer device can be accomplished. A calm transfer is possible. The gripping devices may be arranged at a spacing from each other in the direction of the drill string axis. In particular, the gripping device can have a fixed angle relative to the drill string axis, so that in particular rod sections lying substantially parallel to the drill string axis can be easily grasped.

In one preferred embodiment, multiple separating elements are arranged on the head pieces, being staggered and extending along the drill string axis. The offset is chosen substantially such that the separating elements extend substantially parallel along the drill string axis. The length by which the separating elements are staggered along the drill string axis is less than half the length of the rod sections. The length of the separating elements is preferably less than a third of the length of the rod sections, particularly preferably less than a quarter of the length of the rod sections, particularly preferably less than a fifth of the length of the rod sections, particularly preferably less than a sixth of the length of the rod sections, most particularly preferably less than a seventh of the length of the rod sections. In this way, material can be economized, and furthermore a clear separation is formed for the compartments of the individual rod sections. Weight and material can be economized.

The invention also creates a use for a ground drilling device, having a drilling carriage, which defines a drill string axis, a drill rod magazine for a plurality of rod sections and a transfer device for the transfer of a rod section between the drill rod magazine and a position of the rod section in the direction of the drill string axis. A guide is used for a movement of the transfer device, being formed on the drill rod magazine.

In one preferred embodiment, the guide has a greater extension transverse to the drill string axis than does the drill rod magazine. The guide may be configured longer in the direction transverse to the drill string axis than the drill rod magazine itself, so that a secure transport out from the drill rod magazine and next to the drill rod magazine is possible by means of the transfer device, which is led along the guide.

The term "comprise" in the sense of the specification encompasses both the inherent meaning of the term, that further elements may be provided besides the elements mentioned (a non-exhaustive listing), but also the meaning that the term "comprise" is used synonymously with "consist of" and "formed from".

The aspect of the use of the ground drilling device relates in analogous manner to the remarks about the aspect of the ground drilling device itself. The resulting design and configuration of the ground drilling device may also be reflected in the use.

The preceding remarks, just as the following description of exemplary embodiments, do not constitute any abandonment of particular embodiments or features.

BRIEF DESCRIPTION OF THE DRAWINGS

The invention shall now be explained more closely with the aid of an exemplary embodiment presented in the drawing. The drawings show.

DETAILED DESCRIPTION

Figure 1:
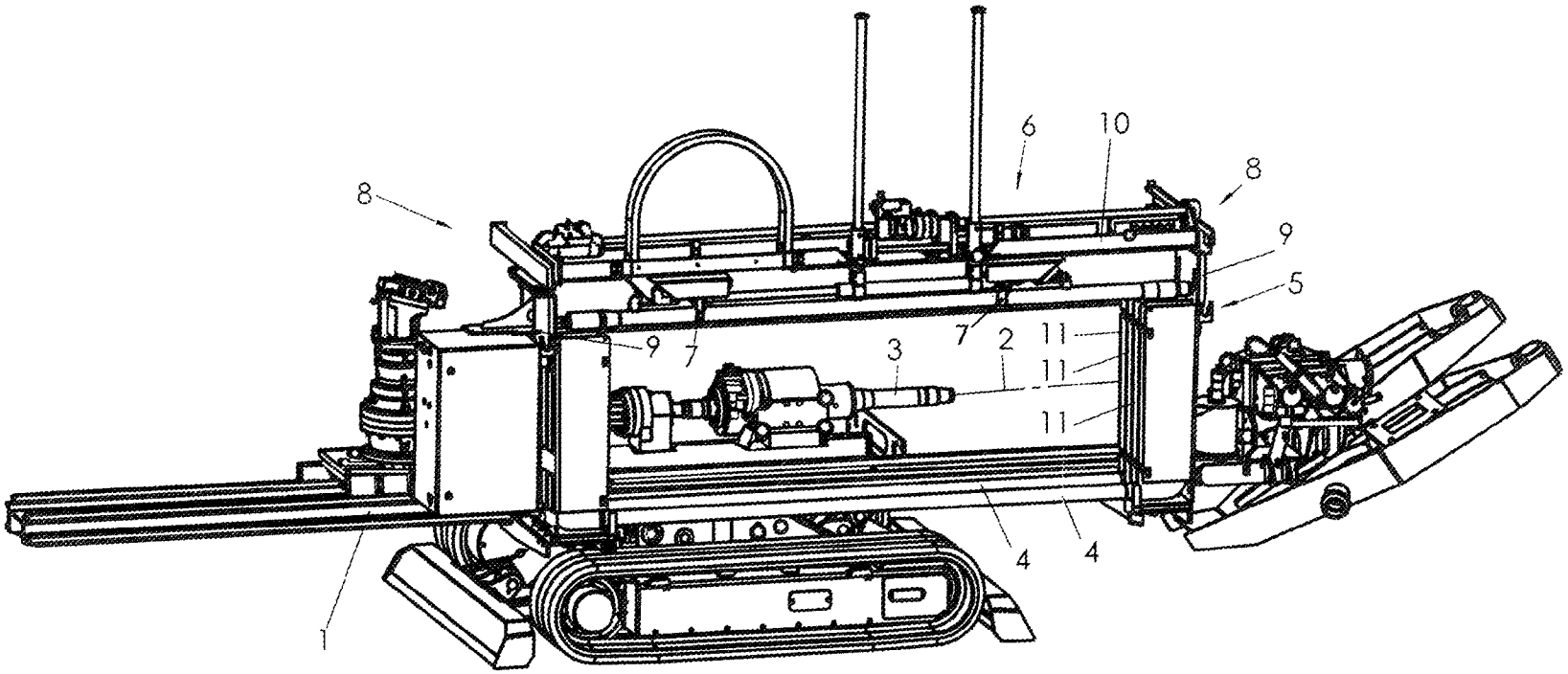
FIG. 1 a region of a ground drilling device with a drill rod magazine and a drilling carriage and FIG. 2 a detail view of FIG. 1 with a guide and a gripping device.

FIG. 1 shows a section of a ground drilling device with which an earth borehole can be made in the soil. The ground drilling device comprises a drilling carriage 1. The drilling carriage 1 defines a drill string axis 2, shown schematically in the figure in the form of a broken line. Along the drill string axis 2 a drive element 3 can move, being arranged on or at a sliding carriage. The drive element 3 may be connected to rod sections 4, which are arranged in a drill rod magazine 5, in order to connect them to the already introduced drill string and drive them into the soil. The drill rod magazine 5 comprises separating elements 11, which extend substantially along the drill string axis 2, offset from it. The separating elements 11 form compartments or rows situated alongside each other in order to hold the rod sections 4. The rod sections 4 can be arranged one above another in the compartments.

In order to take up the rod sections 4 stored or stockpiled in the drill rod magazine 5 and transfer them to the drill string axis 2, there is provided a transfer device 6, having two gripping devices 7 with which a rod section 4 can be grasped. The gripping devices 7 can be moved vertically and horizontally, both transversely to and also in the longitudinal direction, parallel to the drill string axis. A guide 8 is arranged on the drill rod magazine 5, making possible a horizontal movement of the gripping devices 7. In this way, a rod section 4 can be moved transversely to the drill string axis 2. A guide 8 is connected respectively to a head piece 9 of the drill rod magazine 5 at the head end. In the embodiment represented in FIG. 1, there is a direct connection between the guide 8 and the head piece 9. The guide 8 is designed as a linear guide. One end each of a beam 10, on which the gripping devices 7 are arranged, is led in one of the guides 8.

For the moving of the gripping devices 7 in the substantially vertical direction, the gripping devices 7 are led movably in height on the beam 10.

Figure 2:
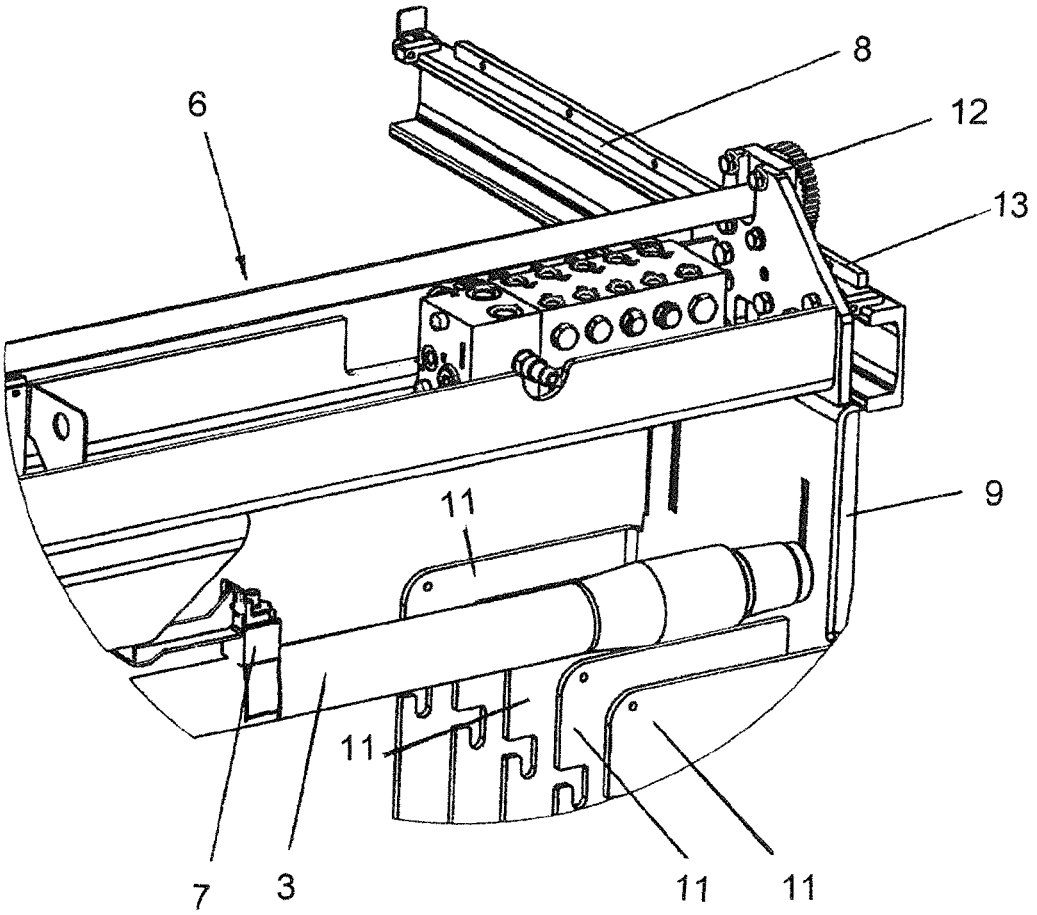

FIG. 2 shows a detail view of FIG. 1 with an enlarged representation of the guide 8, being connected to the head piece 9. The guide 8 is arranged above the head piece 9 of the drill rod magazine 5. The transfer device 6, which comprises the gripping device 7, is movable transversely to the lengthwise extension of the drill rod magazine 5 by means of a driven gear 12, which meshes with a rack 13 of the guide 8.

The invention claimed is:

1. A ground drilling device comprising:

a drilling carriage which defines a drill string axis, a drill rod magazine for a plurality of rod sections, having first and second longitudinal ends, and a head piece at each of the ends arranged transverse to the lengthwise extension of the drill rod magazine, a transfer device for the transfer of a rod section between the drill rod magazine and a position of the rod section in the direction of the drill string axis, and a guide, configured to dictate a direction of movement of the transfer device, extending along a width of each head piece of the drill rod magazine the guide arranged transverse to the lengthwise extension of the drill rod magazine.

2. The ground drilling device according to claim 1, wherein the guide is configured for movement of the transfer device transversely to the drill string axis.

3. The ground drilling device according to claim 1, wherein each head piece is adapted for separate connection to the drilling device.

4. The ground drilling device according to claim 1, wherein the drill rod magazine is configured with no connection struts between the two head pieces.

5. The ground drilling device according to claim 1, wherein the transfer device comprises two gripping devices for grasping one of the rod sections.

6. The ground drilling device according to claim 1, further comprising multiple separating elements arranged on head pieces of the drill rod magazine, said multiple separating elements being staggered and extending along the drill string axis, and wherein the length by which the separating elements are staggered along the drill string axis is less than one-half of the length of the rod section.

7. The ground drilling device according to claim 1, wherein the guide has a greater extension transverse to the drill string axis than that of the drill rod magazine.

8. The ground drilling device of claim 1, wherein the guide being disposed on the drill rod magazine comprises the guide being connected to the drill rod magazine.

9. The ground drilling device of claim 8, wherein the guide being connected to the drill rod magazine comprises the guide being connected to a head piece of the drill rod magazine.

10. A process of ground drilling using a ground drilling device including a drilling carriage defining a drill string axis, and a drill rod magazine for a plurality of rod sections, having first and second longitudinal ends, and a head piece at each of the ends arranged transverse to the lengthwise extension of the drill rod magazine, comprising:

transferring a rod section between the drill rod magazine and a position of the rod section in the direction of the drill string axis via a transfer device, a direction of movement of the transfer device being dictated by a guide extending along a width of each head piece, the guide arranged transverse to the lengthwise extension of the drill rod magazine.

11. The process of claim 10, wherein dictating the direction of movement of the transfer device by the guide comprises guiding the transfer device transversely to the drill string axis.

12. The process of claim 10, wherein each of the two head pieces is adapted for separate connection to the drilling device.

13. The process of claim 10, further comprising grasping, with two gripping devices of the transfer device, one of the rod sections.

14. The process of claim 10, further comprising arranging multiple separating elements on the two head pieces of the drill rod magazine, said multiple separating elements being staggered and extending along the drill string axis, and wherein the length by which the separating elements are staggered along the drill string axis is less than one-half of the length of the rod section.

15. The process of claim 10, wherein the guide is connected to the drill rod magazine.

16. The process of claim 15, wherein the guide is connected to a head piece of the drill rod magazine.

* * * * *